United States Patent [19]

Kleine et al.

[11] 4,248,025

[45] Feb. 3, 1981

[54] KNOCK DOWN POLE CONSTRUCTION

[75] Inventors: Richard A. Kleine, Peoria; Warren J. Byers, Morton, both of Ill.

[73] Assignee: Unarco Industries, Inc., Chicago, Ill.

[21] Appl. No.: 64,757

[22] Filed: Aug. 8, 1979

[51] Int. Cl.[3] ..... E04H 12/08

[52] U.S. Cl. ..... 52/731; 52/40; 174/45 R

[58] Field of Search ..... 52/40, 731, 720, 726, 52/730; 174/45 R

[56] References Cited

U.S. PATENT DOCUMENTS

| | | | |
|---|---|---|---|
| 3,196,990 | 7/1965 | Handley | 52/731 |
| 3,217,459 | 11/1965 | Meyer | 52/731 X |
| 3,276,182 | 10/1966 | Handley | 52/731 |
| 3,728,837 | 4/1973 | Kiefer | 52/731 |
| 3,969,849 | 7/1976 | Franklin | 52/40 X |
| 4,069,626 | 1/1978 | Schuette | 52/731 X |

FOREIGN PATENT DOCUMENTS

| | | | |
|---|---|---|---|
| 1008156 | 2/1952 | France | 174/45 |

*Primary Examiner*—J. Karl Bell

*Attorney, Agent, or Firm*—Hill, Van Santen, Steadman, Chiara & Simpson

[57] ABSTRACT

A knock down tapered pole for a power-line wherein the pole is comprised of a series of superimposed pole sections with each section including a series of U-shaped bent-corner plates of uniform cross-sectional thickness and a plurality of trapezoidal-shaped flat plates positioned between the bent-corner plates and where the corner plates and the flat plates are secured together by means of fasteners.

8 Claims, 8 Drawing Figures

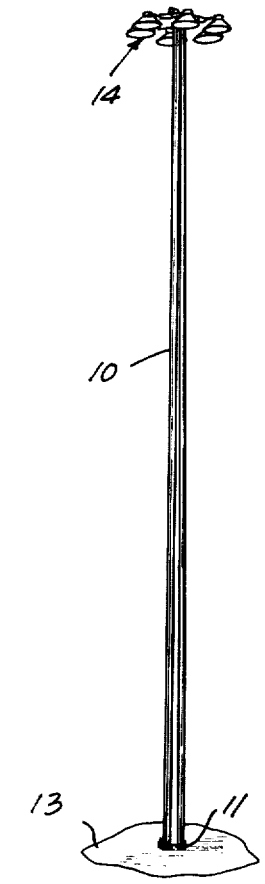
Fig. 1
Fig. 2
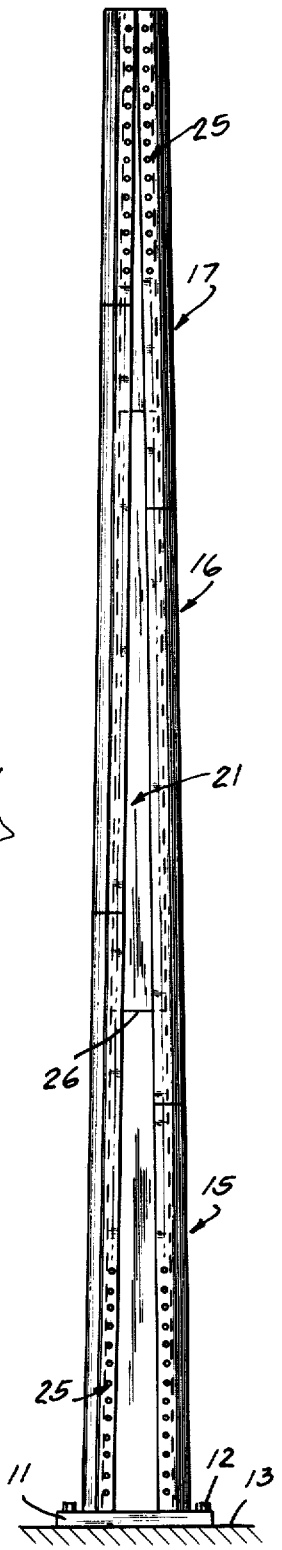
Fig. 3
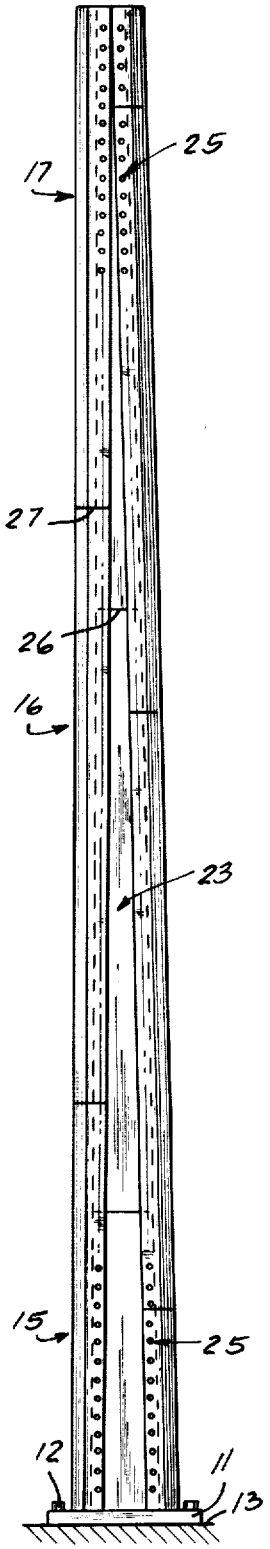
Fig. 4
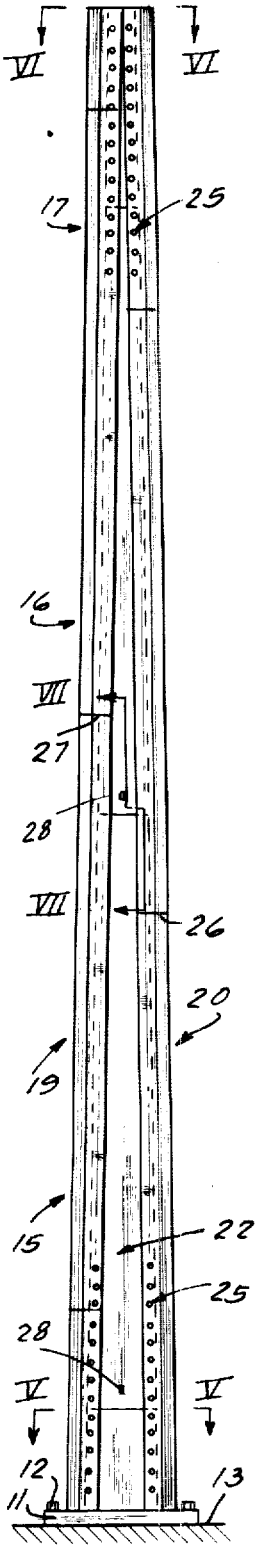

KNOCK DOWN POLE CONSTRUCTION

The present invention relates to a knock down tapered pole for power-line use and the like. The present invention more particularly relates to a pole that is comprised of a series of superimposed pole sections. Each of the sections is comprised of a series of U-shaped bent-corner plates of uniform cross-sectional thickness and a plurality of trapezoidal-shaped flat plates positioned between the bent-corner plates and secured therewith by means of fasteners.

By providing a construction of the type generally outlined above, the shipping costs for the transportation of the components of the pole can be materially reduced as compared to conventional type poles now being sold in the marketplace. As an example, expressway lighting poles are of a substantial length and many of them are of a tubular construction having long lengths which are very expensive to ship and which make the handling of the same difficult as compared with a knock down tapered pole of the type herein disclosed. Another pole shown in the prior art is illustrated in U.S. Pat. No. 3,276,182, where the pole is of an extruded construction and is comprised of elongated lengths of material where the marginal edges are secured by a tongue and groove construction. A pole of the type shown in the U.S. Pat. No. 3,276,182 is not of a knock down construction where the overall length of the pole can be reduced to facilitate shipment.

An important object of this invention is to provide a new and improved knock down tapered pole for sundry uses such as for a power-line or for lighting in interchange of an expressway and the like.

According to important features of this invention, we have provided a knock down tapered pole for power-line use that is comprised of a series of vertically connected sections. Each of the sections is individually comprised of a spaced series of generally U-shaped bent-corner plates of uniform cross-sectional thickness. The corner plates have divergently extending marginal legs with holes being positioned in longitudinal spaced relation along each of the margins. A plurality of spaced trapezoidal-shaped flat plates are each positioned between a pair of the corner plates. The plates have nonparallel marginal edges which converge in a direction extending towards a top end of the pole and which diverge in a direction extending towards a lower end of the pole. A series of fasteners are provided for coaction with the holes for joining opposite margins of the flat plates along the nonparallel marginal edges in assembled relation with the marginal legs of the corner plates.

According to other features of this invention, the trapezoidal-shaped flat plates are each provided with upper and lower edges and these edges on each section are positioned in parallel, vertically-spaced relation relative to one another. When the components are assembled, the upper and lower edges on the trapezoidal-shaped flat plates are engaged in butt-facing edgewise relation with corresponding edges on an adjacent trapezoidal-shaped flat plate.

Accordingly, another important object of this invention is to provide a new and improved knock down tapered pole wherein the sections have a series of vertically-spaced joints with the joints on each section being arranged in staggered relation so as to provide a reinforced construction.

A further feature of this invention concerns a tapered pole having a spaced series of generally U-shaped bent-corner plates in combination with a plurality of spaced trapezoidal-shaped flat plates and where holes are provided in each of the plates with the geometry of the holes being so arranged so that fasteners can be used to secure the components in assembled relation.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which:

FIG. 1 is a perspective view of a high-level lighting pole for use on an interchange of an expressway and the like;

FIG. 2 is an enlarged side elevation of one of the three sides of the pole shown in FIG. 1, only with the lighting structure omitted;

FIG. 3 is an enlarged elevation of another side of the pole shown in FIG. 2, only as viewed from a different vantage point;

FIG. 4 is an enlarged side elevation similar to FIGS. 2 and 3, only viewing a third side of the pole;

Figure 5:
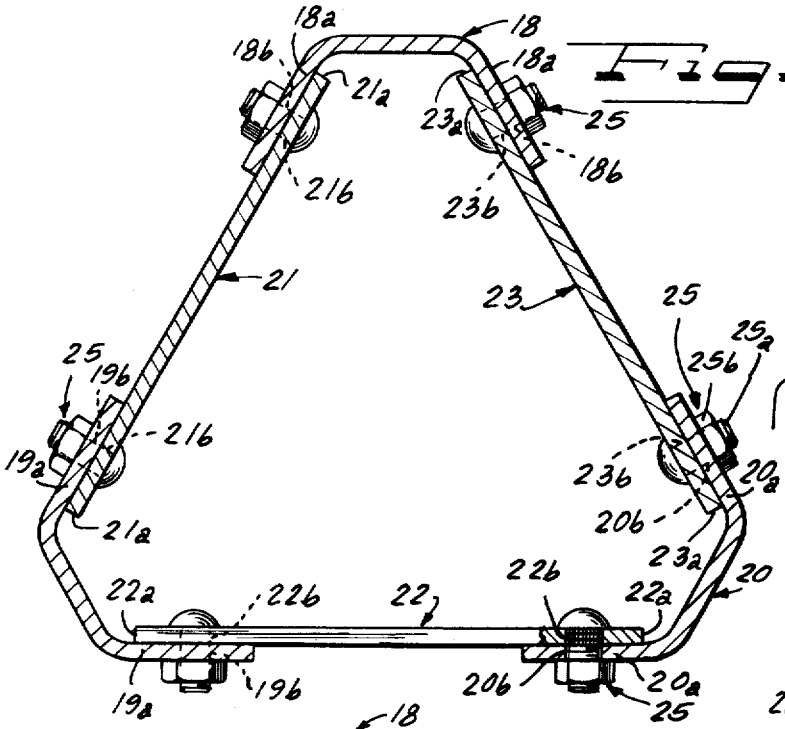
FIG. 5 is a transverse section of the pole taken along a line identified at V—V, shown in FIG. 4, looking in the direction indicated by the arrows.
Figure 6:
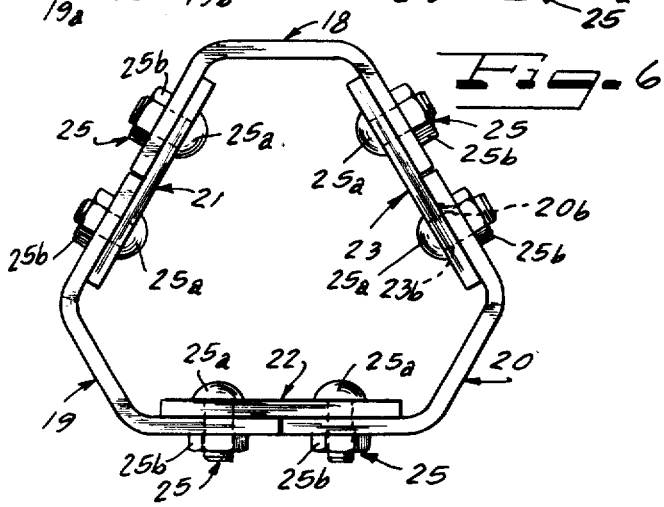
FIG. 6 is an enlarged transverse section of the poles taken along a line identified at VI—VI, shown in FIG. 4, looking in the direction indicated by the arrows.
Figure 7:
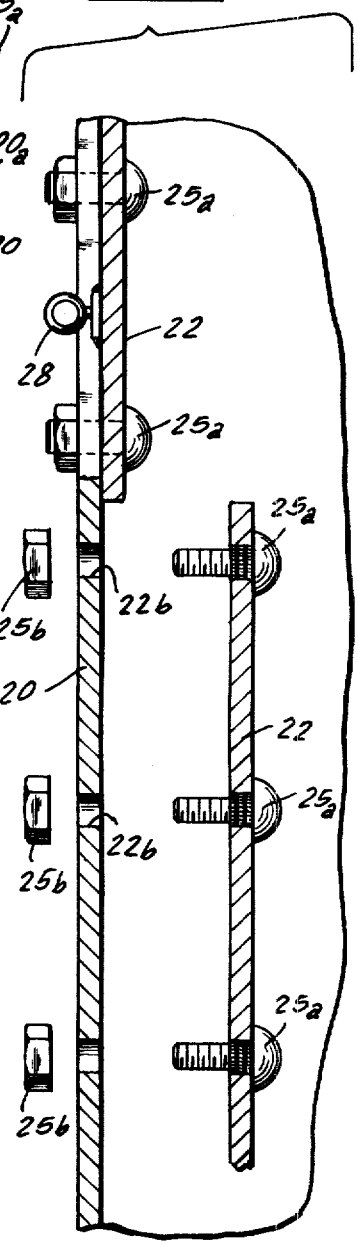
FIG. 7 is an enlarged exploded section as viewed on the line VII—VII, looking in the direction indicated by the arrows.

The reference numeral 10 indicates generally a knock down tapered pole which has a base 11 that is bolted at 12 to a concrete support indicated generally at 13. Disposed at the top end of the pole 10 is a battery of lights 14 such as would typically be used to light up the interchange of an expressway and the like. The pole 10 can be used for any suitable purpose such as for a power-line and the like. The pole 10 is comprised of a series of vertically superimposed sections 15, 16 and 17.

Each of the sections 15, 16 and 17 is comprised of a spaced series of generally U-shaped bent-corner plates 18, 19 and 20. The corner plates have divergently extending marginal legs 18*a*—18*a*, 19*a*—19*a* and 20*a*—20*a*. Holes 18*b*, 19*b* and 20*b* are positioned in longitudinally spaced relation along the marginal legs of the associated corner plate.

A plurality of trapezoidal-shaped flat plates 21, 22 and 23 are each positioned between a pair of the associated corner plates, as shown in FIG. 5. The corner plates are provided with nonparallel marginal edges 21*a*—21*a*, 22*a*—22*a* and 23*a*—23*a*. It will be noted that the edges 21*a*—21*a*, 22*a*—22*a* and 23*a*—23*a* converge in the direction extending towards a lower end of the pole 10 and diverge in a direction extending towards a lower end of the pole. These plates are further provided with holes that are so positioned as to be oriented for cooperative association with corresponding holes 18*b*, 19*b* and 20*b* in the corner plates 18, 19 and 20. These flat plate holes are indicated at 21*b*, 22*b* and 23*b*.

A series of nut-and-bolt fasteners as indicated at 25 are provided for coaction with the aligned holes in the bent-corner plates 18, 19 and 20 and the flat plates 21, 22 and 23. The fasteners 25 include threaded bolts 25*a* and nuts 25*b* which coact in the securement of the bent-corner plates 18, 19 and 20 with the flat plates 21, 22 and 23. In this respect, the flat plates 21 and 22 and 23 are all disposed inside the tube defined by the pole 10. When the corner plates and the flat plates are bolted, they coact to form a generally equal-sided triangular shaped post with cropped or cut-off corners. The bolted construction allows for a knocked-down shipment of the components to the erection site in a comparatively small package. The components of this structure are fabricated in lengths of approximately 20 feet, excepting for the top and bottom sections. By using the bolted construction of this post structure, abutting faces of the plates are tightly clamped together providing frictional interplay between the faces of the bolted elements, which is effective to greatly reduce the shear loads placed upon the bolts. Thus far, the use of rivets for a structure of this type have not been found to be desirable since rivets tend to relax from their initial hold upon cooling and generally provide an inadequate connection between the plates. Any looseness between the plates would diminish the use of the post sections for if the post is subjected to excessive sway, high shear forces would be placed on the rivets. The post sections are tapered approximately 1 to 1½ inches per 10-foot of length. This taper provides for the connection of the bent-corner plates in a converging fashion and the holes that are provided in the edge portions or margins of the bent plates and the flat plates are positioned to accommodate the connecting fasteners 25 comprised of threaded bolts 25*a* plus nuts 25*b*. The hole spacings in the margins of the bent-corner plates and in the flat plates are arranged to accommodate assembly of the components of the post so that seams between the various 20-foot lengths of the post components are spaced in maximum interval relative to the seams of adjacent plate sections. These seams between the upper and lower edges of the trapezoidal plates are indicated by the reference numerals 26. Seams 27 are provided between upper and lower U-shaped plates or on the abutting stacked post sections. The seams 26 and 27 are all staggered in a parallel nonplanar relation to maximize the strength of the post. By this arrangement, seams between upper and lower edges of the associated butt-engaged vertically-extending plates are located in different elevational planes. As illustrated, drive bolts 25*a* are spline locked in the bolt hole of the flat plate to prevent turning and to facilitate assembly and eliminate the need for securing the bolt heads while tightening down nuts 25*b* thereon. This arrangement of providing the drive bolts is useful to facilitate attachment of the flat plate to be assembled with the U-shaped plates. In addition, hooks 28 are provided to aid in drawing the last flat plate into aligned position with the associated U-shaped plates 18 and 19. The bolted posts are preferably assembled with the flat-tapered plates inward of the bent-corner plates for ascetic reasons. As will be observed from FIG. 5, in the preferred embodiment each of the bent-corner plates is provided with a flat leg and two diverging flat legs which extend therefrom as previously described.

Figure 8:
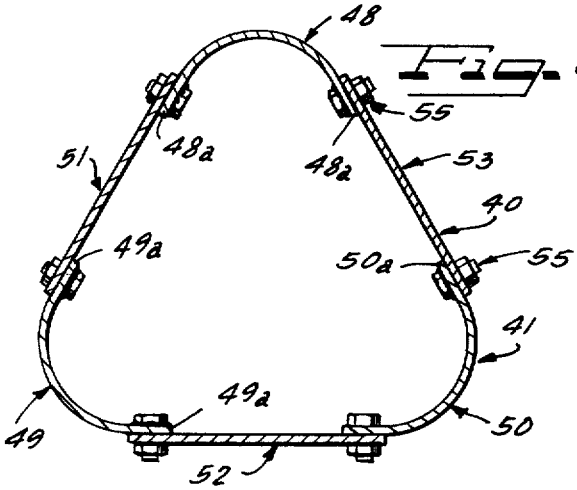
FIG. 8 is a transverse section similar to FIG. 5, only illustrating a modified form of the invention.

In FIG. 8, is shown a modified post construction 40. The post 40 is provided with a series of vertically superimposed sections similar to the sections 15, 16 and 17 with only one of the sections being shown at 41. Each of the posts is provided with a series of generally U-shaped bent-corner plates 48, 49 and 50. The corner plates have divergently extending marginal legs 48*a*—48*a*, 49*a*—49*a* and 50*a*—50*a*. In addition, a series of trapezoidal-shaped flat plates 51, 52 and 53 are each positioned between a pair of the associated corner plates, as shown in FIG. 8. The corner plates are provided with nonparallel marginal edges similar to the edges 21*a*—21*a*, etc. as disclosed in FIG. 5, but which edges are lapped on the outside of the post 40 rather than on the inside as shown in FIG. 5. Welded fasteners 55 are provided for securing the components in assembled relation in the manner as previously described in connection with the manner in which the fasteners 25 coact with the pole 10 for securing the U-shaped bent-corner plates with the trapezoidal-shaped flat plates, also as illustrated in FIG. 5 and 8, respectively.

It will be understood that variations and modifications may be effected without departing from the spirit and scope of the novel concepts of this invention.

We claim as our invention:

1. A knock down tapered pole for power-line use comprising a series of vertically connected sections, each of said sections being comprised, as follows: a spaced series of generally U-shaped bent-corner plates of uniform cross-sectional thickness, said corner plates having divergently extending marginal legs with holes positioned in longitudinal spaced relation along each of said margins, a plurality of spaced trapezoidal-shaped flat plates each positioned between a pair of said corner plates, the flat plates each having nonparallel marginal edges which converge in the direction extending towards a top end of the pole and which diverge in the direction extending towards a lower end of the pole, and a series of fasteners cooperable with said holes joining opposite margins of said flat plates along said nonparallel marginal edges in assembled relation with said marginal legs of said corner plates.

2. The pole of claim 1, further characterized by said trapezoidal-shaped flat plates each having upper and lower edges and with these edges on each section being positioned in parallel vertically spaced relation relative to one another and being engaged in butt-facing-edgewise engagement with corresponding adjacent edges on an adjacent trapezoidal-shaped flat plate.

3. The pole of claim 1 further characterized by the trapezoidal-shaped plates having holes positioned along the nonparallel marginal edges for alignment with the holes in the marginal legs of the corner plate and for receiving said fasteners to secure the assembly in unitary relation.

4. The pole of claim 1 further characterized by the U-shaped bent-corner plates having cropped corners and with the marginal edges of the flat plates being underlapped relative to said corner plate.

5. The pole of claim 1 further characterized by the generally U-shaped bent-corner plates being positioned in underlying relation relative to the nonparallel marginal edges of said flat plate and with the U-shape of the bent-corner plates being arcuate in configuration.

6. The pole of claim 2 further characterized by the U-shaped bent-corner plates having upper and lower edges and with these edges on each section being positioned in parallel vertically spaced relation relative to one another and being butt-engaged in butt-facing-edgewise engagement edges on an adjacent U-shaped bent-corner plate.

7. The pole of claim 1 further characterized by at least certain of the U-shaped bent-corner plates and the trapezoidal-shaped flat plate on each section having stepped edges and with these stepped edges being butt-engaged with correspondingly configured stepped edges on the U-shaped bent-corner plates and the trapezoidal-shaped flat plates on an adjacent section to provide a series of parallel nonplanar joints between the thus-engaged sections.

8. The pole of claim 1 further characterized by at least one group of fasteners including press-fitted threaded bolts secured with one of said plates and nuts associated therewith to facilitate assembly of a last plate to be assembled on the pole and with the last further having means to aid in drawing the plate into an aligned position with the associated plate to aid in the securement of the nuts on to the press-fitted threaded bolts.

* * * * *